US011131275B2

(12) United States Patent
Zito et al.

(10) Patent No.: US 11,131,275 B2
(45) Date of Patent: Sep. 28, 2021

(54) INJECTION METHOD AND SYSTEM FOR THE INJECTION OF WATER IN AN INTERNAL COMBUSTION ENGINE

(71) Applicant: MARELLI EUROPE S.p.A., Corbetta (IT)

(72) Inventors: Antonio Zito, Bologna (IT); Antonio Barbuto, Bologna (IT)

(73) Assignee: MARELLI EUROPE S.p.A., Corbetta (IT)

( * ) Notice: Subject to any disclaimer, the term of this patent is extended or adjusted under 35 U.S.C. 154(b) by 0 days.

(21) Appl. No.: 16/826,600

(22) Filed: Mar. 23, 2020

(65) Prior Publication Data

US 2020/0309068 A1 Oct. 1, 2020

(30) Foreign Application Priority Data

Mar. 28, 2019 (IT) ..... 102019000004639

(51) Int. Cl.
*F02M 25/022* (2006.01)
*F02B 47/02* (2006.01)
(Continued)

(52) U.S. Cl.
CPC ..... *F02M 25/0227* (2013.01); *F02B 47/02* (2013.01); *F02D 41/0025* (2013.01); *F02D 41/042* (2013.01); *F02M 25/028* (2013.01); *F02M 25/0222* (2013.01); *F02M 25/0224* (2013.01)

(58) Field of Classification Search
CPC ..... F02B 47/02; F02M 25/0227
See application file for complete search history.

(56) References Cited

U.S. PATENT DOCUMENTS 6,196,409 B1 3/2001 Lake et al.
2007/0283685 A1 12/2007 Ripper et al.
(Continued)

FOREIGN PATENT DOCUMENTS

DE 102004054238 A1 5/2006
DE 102016200694 A1 7/2017
(Continued)

OTHER PUBLICATIONS

Search Report for Italian Patent Application No. 201900004639 dated Nov. 14, 2019.
(Continued)

*Primary Examiner* — Kevin A Lathers
(74) *Attorney, Agent, or Firm* — Howard & Howard Attorneys PLLC

(57) ABSTRACT

Injection method and system for the injection of water in an internal combustion engine; the following steps are substantially comprised: operating, when the internal combustion engine is turned on, a reversible pump in order to suck water from a tank and feed the water under pressure to an injector through a feeding duct; cyclically opening, when the internal combustion engine is turned on, the injector in order to inject the water towards at least one cylinder of the internal combustion engine; and draining the water, when the internal combustion engine is turned off, from the injector and the feeding duct by using a release valve connecting the feeding duct to the outside.

14 Claims, 2 Drawing Sheets

(51) Int. Cl.

| | |
|---|---|
| ***F02D 41/00*** | (2006.01) |
| ***F02D 41/04*** | (2006.01) |
| ***F02M 25/028*** | (2006.01) |

(56) References Cited

U.S. PATENT DOCUMENTS

| | | | | |
|---|---|---|---|---|
| 2018/0163595 | A1* | 6/2018 | Gharpure | F01N 3/2066 |
| 2019/0107080 | A1* | 4/2019 | Heidemeyer | F02M 25/025 |

FOREIGN PATENT DOCUMENTS

| | | | | |
|---|---|---|---|---|
| DE | 102016216570 | A1 * | 3/2018 | F01N 3/2066 |
| DE | 102016216570 | A1 | 3/2018 | |
| EP | 2116700 | A1 | 11/2009 | |
| EP | 2492128 | A1 | 8/2012 | |
| EP | 2669484 | A2 | 12/2013 | |
| FR | 3069197 | A1 | 1/2019 | |
| WO | 2017137101 | A1 | 8/2017 | |
| WO | 2019020468 | A1 | 1/2019 | |

OTHER PUBLICATIONS

Extended European Search Report for European Patent Application No. 20166519.7 dated Jul. 6, 2020.

* cited by examiner

INJECTION METHOD AND SYSTEM FOR THE INJECTION OF WATER IN AN INTERNAL COMBUSTION ENGINE

CROSS-REFERENCE TO RELATED APPLICATIONS

This Patent Application claims priority from Italian Patent Application No. 102019000004639 filed on Mar. 28, 2019, the entire disclosure of which is incorporated herein by reference.

TECHNICAL FIELD

The invention relates to an injection method and to a system for the injection of water in an internal combustion engine.

PRIOR ART

As it is known, when dealing with internal combustion engine, manufacturers suggested feeding water, in addition to fuel, into the combustion chambers defined inside the cylinders.

In an internal combustion engine, the water injection system consists of introducing water into the engine through the intake duct, in the form of spray, or mixed with fuel, or directly into a combustion chamber, so as to cool the air/fuel mixture, thus increasing the resistance to knock phenomena. Water has a high latent heat of vaporization; in other words, it requires a lot of energy to shift from the liquid state to the gaseous state. When water at ambient temperature is injected into the intake duct, it absorbs heat from the air flowing in and from the metal walls, evaporating, thus cooling the substance flowing in. Hence, the engine takes in fresher air, in other words thicker air, the volumetric efficiency is improved and the knock possibility is reduced, furthermore more fuel can be injected. During the compression, the water present in very small drops evaporates and absorbs heat from the air being compresses, cooling it down and lowering the pressure thereof. After the compression, the combustion takes place and there is a further beneficial effect: during the combustion, a lot of heat develops, which is absorbed by the water, reducing the peak temperature of the cycle and reducing, as a consequence, the formation of Nox and the heat to be absorbed by the walls of the engine. This evaporation further transforms part of the heat of the engine (which would otherwise be wasted) into pressure, resulting from the vapour that was formed, thus increasing the thrust upon the piston and also increasing the flow of energy into a possible turbine of the exhaust (the turbine, furthermore, would benefit from the decrease in the temperature of the exhaust gases due to the absorption of heat by the additional water).

The water feeding system comprises a tank, which is filled with demineralised water (to avoid the formation of scaling); the tank can be filed from the outside of the vehicle or it could also be filled using the condensate of the air conditioning system, using the condensate of the exhaust or even conveying rain water. Furthermore, the tank is generally provided with an electric heating device (namely, provided with a resistance generating heat through Joule effect when it is flown through by an electric current), which is used to melt possible ice when the temperature on the outside is particularly low.

The water feeding system further comprises (at least) an electromagnetic injector, which receives the water from the tank through a pump drawing it from the tank and is completely similar to the electromagnetic injectors currently used for the injection of fuel in internal combustion engines. In this way, it is possible to use already existing, highly efficient and extremely reliable components and, therefore, there is no need to develop new components, with an evident saving in terms of money and time.

Water freezes at a temperature of 0° C., which can easily be reached by a vehicle that, in cold weathers and in the winter time, is parked on the outside; possible residual water left inside the electromagnetic injector could freeze when the vehicle is parked, thus causing damages to the electromagnetic injector. In order to avoid damages caused by the freezing of water inside the electromagnetic injector and the feeding duct, when the internal combustion engine is turned off, the electromagnetic injector and the feeding duct must be emptied. In order to empty the electromagnetic injector and the feeding duct when the internal combustion engine is turned off, manufacturers usually use a reversible pump, which is operated so as to suck the water present inside the electromagnetic injector and the feeding duct into the tank; this operation requires the electromagnetic injector to be opened so as to suck air into the electromagnetic injector and the feeding duct as the pump empties the electromagnetic injector and the feeding duct. However, by operating in this way, part of the air present inside the intake duct is necessarily sucked into the electromagnetic injector and the feeding duct, though said air, on the one hand, can have a relatively high temperature (due to the possible presence of exhaust gases recirculated through the EGD circuit) and, on the other hand, can have a significant concentration of contaminating/scaling elements, for example large-sized particulate matter (due to the possible presence of exhaust gases recirculated through the EGD circuit); as a consequence, by operating in this way, there are both the risk of overheating the electromagnetic injector and the risk of forming scaling in the electromagnetic injector. In particular, the large-sized particulate matter, which might be present in the air flowing in the intake duct (due to the possible presence of exhaust gases recirculated through the EGD circuit), can quickly clog the filter of the electromagnetic injector; furthermore, possible organic or inorganic substances present in the air flowing in the intake duct could pollute the water stored in the tank, thus supporting an undesired proliferation of micro-organisms, which could even force users to empty and wash the tank.

Patent application WO2017137101A1 discloses a water injection system in an internal combustion engine, wherein, when the internal combustion engine is turned on, a reversible pump is operated in order to suck water from a tank and feed the water under pressure to at least one injector through a feeding duct; on the other hand, when the internal combustion engine is turned off, the reversible pump is operated in an opposite direction so as to drain the water from the feeding duct and the injector. In particular, a release valve, is provided, which connects the feeding duct to the outside and is opened during the emptying of the feeding duct.

DESCRIPTION OF THE INVENTION

The object of the invention is to provide an injection method and a system for the injection of water in an internal combustion engine, said injection method and system being easy and economic to be implemented and manufactured, not suffering from the drawbacks described above and, in particular, ensuring an adequate emptying of an injector and of a feeding duct when the internal combustion engine is turned off.

According to the invention, there are provided an injection method and a system for the injection of water in an internal combustion engine according to the appended claims.

The appended claims describe preferred embodiments of the invention and form an integral part of the description.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
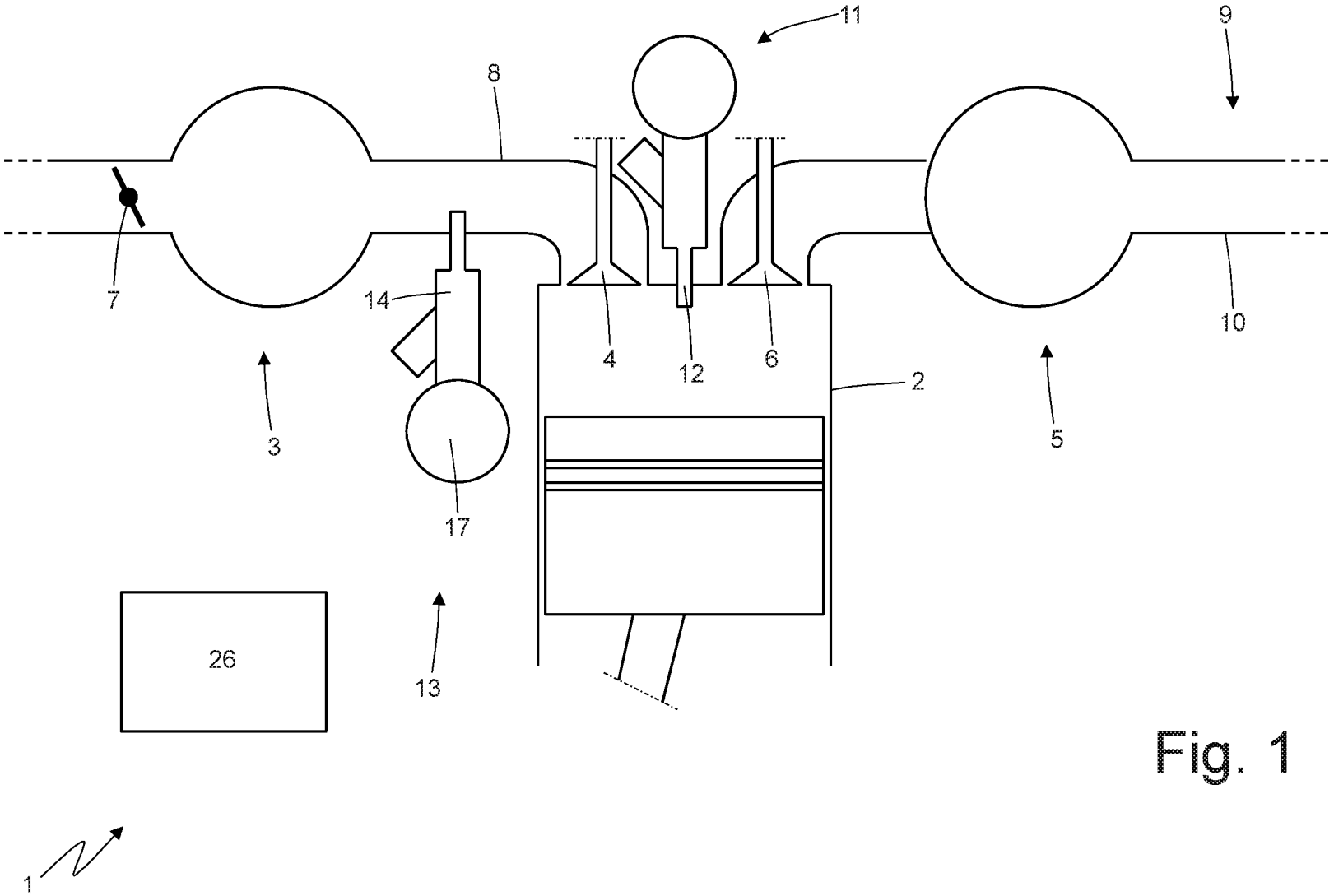
FIG. 1 is a schematic view of an internal combustion engine provided with a water injection system according to the invention.

In FIG. 1, number 1 indicates, as a whole, an internal combustion engine provided with four cylinders 2 (only one of them being shown in the accompanying figure), each connected to an intake manifold 3 through two intake valves 4 (only one of them being shown in the accompanying figure) and to an exhaust manifold 5 through two exhaust valves 6 (only one of them being shown in the accompanying figure).

Inside the intake manifold 3 there is defined an intake chamber (the so-called "plenum chamber"), which receives fresh air (namely, air coming from the outside) through an inlet opening regulated by a throttle valve 7 and communicates with each cylinder 2 through an outlet opening leading into a respective intake duct 8 ending in the area of the two intake valves 4.

The internal combustion engine 1 comprises an exhaust system 9, which releases the gases produced by the combustion into the atmosphere (after proper treatments) and comprises an exhaust duct 10 originating from the exhaust manifold 5.

The internal combustion engine 1 comprises a fuel injection system 11, which injects fuel into the cylinders 2 by means of corresponding electromagnetic fuel injectors (which are normally closed, namely remain closed in the absence of an opening command). In other words, the injection system 11 comprises four electromagnetic fuel injectors 12, each injecting the fuel directly into a respective cylinder 2 and receiving the fuel under pressure from a common rail; the fuel injection system 11 further comprises a high-pressure pump (not shown), which feeds the fuel to the common rail and receives the fuel from a low-pressure pump (not shown) arranged inside a fuel tank (not shown).

The internal combustion engine 1 comprises a water injection system 13, which injects water into the intake ducts 8 by means of corresponding electromagnetic water injectors 14 (which are normally closed, namely remain closed in the absence of an opening command). In other words, the injection system 13 comprises four electromagnetic water injectors 14, each directly injecting water into a respective intake duct 8.

Figure 2:
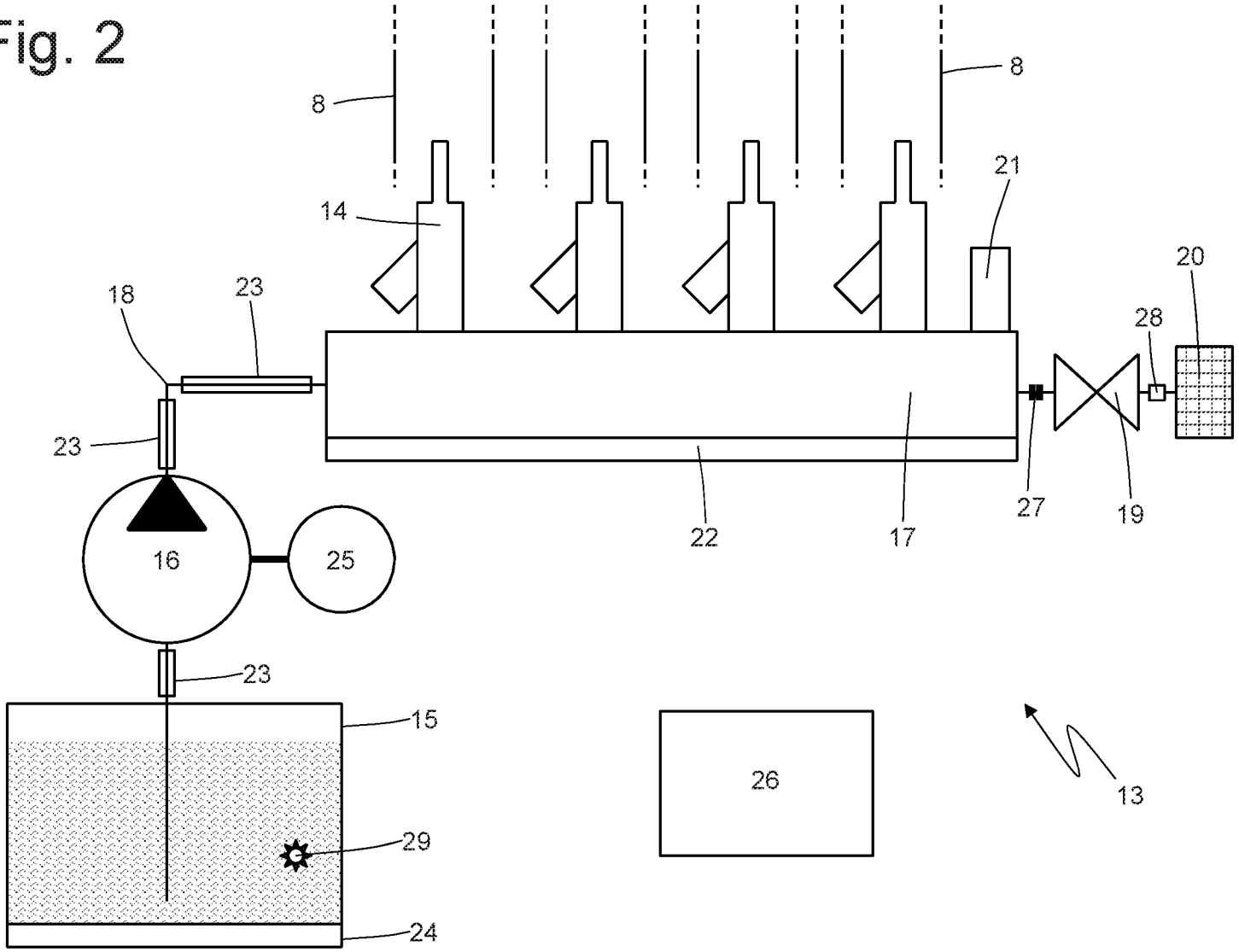
FIG. 2 is a schematic view of the injection system of FIG. 1.

According to FIG. 2, the injection system 13 comprises a tank 15 containing the water and a pump 16, which draws from the tank 15 to feed the water under pressure to a common rail 17 through a feeding duct 18 (which originates from the tank 15 and reaches the common rail 17 going through the pump 16); the common rail 17 is connected to the electromagnetic injectors 14, which, hence, directly receive the water from the common rail 17. In other words, the common rail 17 is the end part of the feeding duct 18, to which the electromagnetic water injectors 14 are connected. It should be pointed out that the pump 16 is reversible, namely it can be operated in a direction to suck the water from the tank 15 and feed the water into the common rail 17 through the feeding duct 18 and can be operated in an opposite direction to suck the water from the common rail 17 and feed the water into the tank 15 through the feeding duct 18.

Each electromagnetic injector 14 is designed to inject the atomized water into the corresponding intake duct 8 and is fixed to the common rail 17, namely is directly mounted on the common rail 17.

In the embodiment shown in FIG. 2, each electromagnetic injector 14 is mounted in the area of an upper portion of the corresponding intake duct 8 and is (vertically) oriented from the bottom to the top, so that the injection nozzle of the electromagnetic injector 14 is arranged in the highest point; according to a different embodiment which is not shown herein, each electromagnetic injector 14 is mounted in the area of a lower portion of the corresponding intake duct 8 and is (vertically) oriented from the top to the bottom, so that the injection nozzle of the electromagnetic injector 14 is arranged in the lowest point. In general, each electromagnetic injector 14 is never mounted in a horizontal manner (namely, it is always inclined relative to the horizontal so as to form an angle other than zero with the horizontal), so that, because of gravity, the water present inside the electromagnetic injector 14 is forced to flow towards the injection nozzle (when the injection nozzle is arranged in the lowest point) or is forced to flow in an opposite direction relative to the injection nozzle (when the injection nozzle is arranged in the highest point); obviously, in use, namely when the pump 16 is working, the water pressure generated by the pump 16 is always able to overcome gravity in order to cause the water to flow out of the injection nozzle of each electromagnetic injector 14.

The injection system 13 further comprises a two-way release valve 19 (namely, a valve that allows air to flow in both directions), which is connected to the common rail (namely, originates from the common rail 17) and is designed to connect the common rail 17 to an air intake 20, which communicates with the atmosphere and can be provided with a mechanical filter. According to a possible embodiment, the release valve 19 could consist of an electromagnetic fuel injector, which is used as pneumatic valve; namely, in order to install a component which is already available in the market, a commercial electromagnetic fuel injector (with moderate nominal performances and, hence, a low cost) is used as pneumatic valve and makes up the two-way release valve 19 (therefore, a commercial electromagnetic fuel injector is connected to the common rail 17 so as to establish a connection between the common rail 17 and the air intake 20 communicating with the atmosphere).

The release valve 19 preferably is a solenoid valve (namely, it is provided with an electric actuator which can be remotely controlled) and is movable between a closed position, in which the common rail 17 is (pneumatically) isolated from the air vent 20, and an open position, in which the common rail 17 is (pneumatically) connected to the air vent 20.

The injection system 13 further comprises a pressure sensor 21, which is mounted on the common rail 17 and is designed to detect a pressure $P_{H2O}$ of the water inside the common rail 17; according to a preferred embodiment shown in FIG. 2, the pressure sensor 21 is mounted on the upper surface of the common rail 17 and is arranged vertically, so that the water wets the pressure sensor 21 only when the common rail 17 is full.

According to a preferred embodiment shown in FIG. 2, the injection system 13 comprises an electric heater 22, which is coupled to the common rail 17 and is designed to generate heat to heat the common rail 17 (and, hence, the water contained in the common rail 17), an electric heater 23, which is coupled to the feeding duct 18 and is designed to generate heat to heat the feeding duct 18 (and, hence, the water contained in the feeding duct 18), and an electric heater 24, which is coupled to the tank 15 and is designed to generate heat to heat the tank 15 (and, hence, the water contained in the tank 15).

According to a preferred embodiment shown in FIG. 2, the pump 16 is operated, namely caused to rotate, by an electric motor 25 (for example, a brushless DC motor), which is mechanically integrated with the pump 16.

Finally, the injection system 13 comprises a control unit 26, which controls, among other things, the electric motor 24 of the pump 16, the electromagnetic injectors 14 and the release valve 19.

When the internal combustion engine 1 is turned on (namely, when the injection system 11 injects the fuel into the cylinders 2 and the injection system 13 injects the water into the intake ducts 8), the control unit 26 keeps the release valve 19 permanently closed, controls the pump 16 in order to feed the water under pressure to from the tank 15 to the common rail 17 where the electromagnetic injectors 14 are mounted and cyclically controls each electromagnetic injector 14 in order to inject the atomized water into the corresponding intake duct 8 as a function of the engine point (namely, depending on the features of the combustion inside the cylinders 2). In particular, the control unit 26 controls the pump 16 with a feedback control using the measure of the pressure $P_{H2O}$ provided by the pressure sensor 21 so as to pursue a desired value of the pressure $P_{H2O}$ of the water inside the common rail 17.

When the internal combustion engine 1 is turned off, the control unit 26 controls the pump 16, the electromagnetic injectors 14 and the release valve 19 as described hereinafter in order to drain the water from the electromagnetic injectors 14, the common rail 17 and the feeding duct 18.

When the internal combustion engine 1 is turned off, the control unit 26 operates the pump 16 in order to suck the water from the feeding duct 18 and feed the water into the tank 15. Subsequently, the control unit 26 opens the release valve 19 to establish a communication between the feeding duct 18 and the atmosphere; in this way, through the air vent 20, air is sucked from the atmosphere into the common rail 17 and the feeding duct 18 as the pump 16 empties the common rail 17 and the feeding duct 18.

The control unit 26 does not open the release valve 19 simultaneously with or immediately after the activation of the pump 16 in order to suck the water from the feeding duct 18; in particular, before opening the release valve 19, the control unit 26 waits an amount T1 of time, so as to allow the pump 16 to reduce the residual pressure $P_{H2O}$ of the water inside the common rail 17. In other words, when the internal combustion engine 1 is turned on, the pump 16 keeps the water under pressure inside the common rail 17 and, when the internal combustion engine 1 is turned off, the water inside the common rail 17 has a relatively high residual pressure $P_{H2O}$; in these conditions, if the release valve 19 were opened simultaneously or almost simultaneously with the activation of the pump 16 in order to suck the water from the common rail 17, part of the water under pressure present inside the common rail 17 would flow out through the air vent 20. Furthermore, if the release valve 19 were opened too soon (namely, when there still is not enough water in the common rail 17 and in the feeding duct 18), the pump 16 would end up basically sucking the air flowing in from release valve 19, thus leaving a significant quantity of water in the common rail 17 and in the feeding duct 18.

On the contrary, if one waits the amount T1 of time before opening the release valve 19, the pump 16 is allowed to reduce the residual pressure $P_{H2O}$ of the water inside the common rail 17; hence, when the release valve 19 is opened, the residual pressure $P_{H2O}$ of the water inside the common rail 17 is low (typically, lower than the atmospheric pressure and, in absolute terms, in the range of 0.4-0.5 bar) and, therefore, no water flows out through the air vent 20. Furthermore, if the release valve 19 is opened only when the residual pressure $P_{H2O}$ of the water inside the common rail 17 is lower than the atmospheric pressure, an ideal emptying is always ensured, since the large quantity of air flowing in from the release valve 19 when it is opened (because of the depression present in the common rail 17) tends to act like a "pneumatic pushing element", which pushes all the residual water present in the common rail 17 and in the feeding duct 18 towards the tank 15.

In particular, the control unit 26 uses the pressure sensor 21 to check when the pressure $P_{H2O}$ of the water inside the common rail 17 stops decreasing and, hence, opens the release valve 19 only when the pressure $P_{H2O}$ of the water inside the common rail 17 stops decreasing (reaching a value that is smaller than the atmospheric pressure). According to a possible embodiment, the control unit 26 opens the release valve 19 only when the pressure $P_{H2O}$ of the water inside the common rail 17 is below a first predetermined threshold value (which is smaller than the atmospheric pressure and, for example, amounts, in absolute terms, to 0.4-0.5 bar) and is established during the design phase. According to an alternative embodiment, the control unit 26 cyclically calculates the first derivative in time of the pressure $P_{H2O}$ of the water inside the common rail 17 (namely, it cyclically calculates the value $dP_{H2O}/dt$) and opens the release valve 19 only when the pressure $P_{H2O}$ of the water inside the common rail 17 is below the first predetermined threshold value and, at the same time, when the pressure $P_{H2O}$ of the water stops decreasing in a significant manner, namely when the first derivative in time of the pressure $P_{H2O}$ of the water is below a second predetermined threshold value, which is established during the design phase.

After having opened the release valve 19, the control unit 26 waits a predetermined amount T2 of time, which is established during the design phase, to allow the pump 16 to completely empty the feeding duct 18 and the common rail 17.

At the end of the amount T2 of time and if the electromagnetic injectors 14 are mounted with the injection nozzle in the highest point, the control unit 26 could even turn off the pump 16 closing the release valve 19, hence ending the draining cycle, since the water contained in the electromagnetic injectors 14 (or at least the greatest part of the water contained in the electromagnetic injectors 14) has flown downward, through gravity, towards the common rail 17, thus (at least partially) emptying the electromagnetic injectors 14, and, therefore, the draining cycle can end. Alternatively, at the end of the amount T2 of time and if the electromagnetic injectors 14 are mounted with the injection nozzle in the highest point, the control unit 26 could open all the electromagnetic injectors 14 (all together at the same time or one at a time in succession) closing the release valve 19 or leaving it open and leaving the pump 16 still active for an amount T3 of time during which there is a guarantee of complete emptying of the electromagnetic injectors 14 thanks to a (moderate) quantity of air flowing into the electromagnetic injectors 14.

After having waited the amount T3 of time, the control unit 26 turns off the pump 16, closes (if it has not done so before) the release valve 19 and closes the electromagnetic injectors 14, thus ending the draining cycle.

The amount T3 of time is very small (as already mentioned above, it could even be zero) so as to minimize the quantity of air sucked through the electromagnetic injectors 14.

At the end of the amount T2 of time, if, on the other hand, the electromagnetic injectors 14 are mounted with the injection nozzle arranged in the lowest point, the control unit 26 turns off the pump 16, leaves the release valve 19 open and, then, opens all the electromagnetic injectors 14 (all together at the same time or one at a time in succession); in these conditions, the residual water present inside each electromagnetic injector 14 flows out, through gravity, through the nozzle of the electromagnetic injector 14 ending up inside the corresponding intake duct 8.

After having opened the electromagnetic injectors 14, the control unit 26 waits a predetermined amount T4 of time, which is established during the design phase, so as to allow each electromagnetic injector 14 to be emptied, because of gravity, from the water, which flows towards the corresponding intake duct 8 and settles inside the intake duct 8. At the end of the amount T4 of time, the electromagnetic injectors 14 are emptied from the water as well and the control unit 26 closes the electromagnetic injectors 14 and the release valve 19 ending the draining cycle (the pump 16 was turned off at the end of the amount T2 of time).

When, on the other hand, the internal combustion engine 1 is started, the feeding duct 18 and the common rail 17 are empty (since they were emptied from the water, as described above, when the internal combustion engine 1 was turned off) and, therefore, they need to be filled.

As a consequence, when the internal combustion engine 1 is started, the control unit 26 operates the pump 16 to feed the water from the tank 15 to the common rail 17 through the feeding duct 18 and, at the same time, it opens the release valve 19 to let out the air present in the feeding duct 18 and in the common rail 17 as the water level increases.

In particular, the control unit 26 uses the pressure sensor 21 to check when the pressure $P_{H2O}$ of the water inside the common rail 17 starts increasing and, hence, closes the release valve 19 only when the pressure $P_{H2O}$ of the water inside the common rail 17 starts increasing. According to a possible embodiment, the control unit 26 closes the release valve 19 only when the pressure $P_{H2O}$ of the water inside the common rail 17 exceeds a third predetermined threshold value, which is established during the design phase.

According to an alternative embodiment, the control unit 26 cyclically calculates the first derivative in time of the pressure $P_{H2O}$ of the water inside the common rail 17 (namely, it cyclically calculates the value $dP_{H2O}/dt$) and closes the release valve 19 only when the pressure $P_{H2O}$ of the water inside the common rail 17 exceeds the third predetermined threshold value and, at the same time, when the pressure $P_{H2O}$ of the water starts increasing in a significant manner, namely when the first derivative in time of the pressure $P_{H2O}$ of the water exceeds a fourth predetermined threshold value, which is established during the design phase.

During the filling, the control unit 26 also has to open the electromagnetic injectors 14 for a given amount of time so as to let the air contained therein out of the electromagnetic injectors 14 (namely, so as to replace air with water inside the electromagnetic injectors 14); during this step, a (moderate) quantity of water could flow out of the electromagnetic injectors 14 in order to settle in the corresponding intake ducts 8. The control unit 26 can open the electromagnetic injectors 14 when the release valve 19 is still open or as soon as the release valve 19 is closed.

After the electromagnetic injectors 14 have been closed as well, the filling cycle ends and, hence, the control unit 26 controls the pump 16 in order to keep the pressure $P_{H2O}$ of the water inside the common rail 17 equal to the desired value.

During the filling step, water flows out of the air vent 20 together with the air "purged out"; in order to avoid (or even only limit) the outflow of water from the air vent 20, along the release duct connecting the common rail 17 to the air vent 20 (hence, upstream or downstream of the release valve 19) there can be inserted a breathable membrane 27, which is permeable to air and impermeable to water (namely, it allows air to flow through it, but it does not allow water to flow through it, since it has a plurality of micro-holes having a size that is smaller than the size of a water molecule). As an alternative or in addition to the breathable membrane 27, along the release duct connecting the common rail 17 to the air vent 20 (hence, upstream or downstream of the release valve 19) there can be inserted a narrowing 28 having an adjusted diameter, which allows for a given air flow rate (which is sufficient to ensure the emptying and the filling in reasonable times) and, at the same time, limits the flow rate of the water than can flow out (in a clearly undesired manner) through the air vent 20.

The control unit 26 is connected to (at least) an outer temperature sensor and, if necessary, also to a temperature sensor 29 measuring the temperature $T_{H2O}$ of the water inside the tank 15; when the outer temperature is below zero (and the internal combustion engine 1 has been still for some time), when the temperature of a cooling liquid of the internal combustion engine 1 is close to zero and/or when the temperature of the water inside the tank 15 is below zero, the control unit 16 turns on the electric heaters 22, 23 and 24 in order to melt possible ice present in the water circuit.

According to a preferred embodiment, in case a temperature $T_{H2O}$ of the water inside the tank 15 is smaller than or equal to a limit value VL, the control unit 26 is configured to turn on the electric heaters 22, 23 and 24. In case the temperature $T_{H2O}$ of the water inside the tank 15 is smaller than or equal to a safety value VS (which is smaller than the limit value VL), the control unit 26 is configured to implement an additional defrosting procedure, which entails controlling the electric motor 25 so as to generate a thermal power due to Joule effect (namely, heat) that is sufficient to defrost the water present inside the pump 16 within a predetermined time limit and without causing the rotation of the rotor (and, hence, of the pump 16). Indeed, possible residual ice present inside the pump 16 could be extremely dangerous for the integrity of the pump 16, because it could break the rotary parts of the pump 16; in other words, possible small-sized or large-sized fragments of ice present inside the pump 16 could break the rotary parts of the pump 16, if the pump 16 were caused to rotate without having previously melted the ice present inside the pump 16.

Based on the result of the comparison between the temperature $T_{H2O}$ of the water and the limit value VL as well as the safety value VS, the following conditions are possible:

- if the temperature $T_{H2O}$ of the water is greater than the limit value VL, the electronic control unit 26 is configured not to implement any defrosting strategy for the water contained inside the tank 15 and the pump 16;
- if the temperature $T_{H2O}$ of the water is comprised between the limit value VL and the safety value VS, the electronic control unit 26 is configured to turn on the electric heaters 22, 23 and 24; and
- if the temperature $T_{H2O}$ of the water is smaller than the safety value VS, the electronic control unit 26 is configured both to turn on the electric heaters 22, 23 and and to control the electric motor 25 so as to help defrost the water inside the pump 16.

Below there is a description of the defrosting strategy implemented by the electronic control unit 26, which entails controlling the electric motor 25 in a non-efficient manner (namely, in the absence of a substantial movement) so as to generate in the windings of the electric motor 25, due to Joule effect, a thermal power that is sufficient to defrost the water inside the pump 16; in other words, the control unit 26 uses the windings of the electric motor 25 not to generate a rotary magnetic field that causes an actual rotation of the rotor (and, hence, of the pump 16), but only as electric resistances to generate heat due to Joule effect.

The electric motor 25 comprises a rotor and a stator comprising at least three stator windings, where the current can flow according to a given sequence so as to cause the rotor to rotate; as it is known, the rotor is caused to rotate by the sequential switching and according to a timing defined by the stator windings located in the stator. The electric motor 25 can alternatively be both an inner motor and an outer motor. The defrosting strategy implemented by the electronic control unit 26 involves supplying a current through the stator windings varying the sequence of the stator windings and/or the timing/frequency.

The stator of the electric motor 25 comprises at least three stator windings, so as to have at least three phases which can be assembled in a star- or triangle-like configuration. Experiments have shown that good results can be obtained with an electric motor 25 provided with a stator comprising six stator windings uniformly arranged around the rotor; in other words, experiments have shown that good results can be obtained with an electric motor 25 in which the stator windings are arranged in a uniform manner around the rotor in the order A, B, C, A, B, C.

The defrosting strategy implemented by the electronic control unit 26 entails supplying a current through the stator windings according to a sequence that is such as to generate a rotation torque of the shaft of the pump 16 (namely, such as to substantially keep the pump 16 still in order to prevent it from being damaged due to the possible ice present on the inside). For example, according to a possible embodiment, the defrosting strategy implemented by the electronic control unit 26 involves supplying the stator windings with a substantially constant electric voltage V and supplying an electric current through the stator windings according, for example, to a sequence A C B A C B. This operating sequence of the stator windings allows for a continuous inversion of the direction of rotation of the pump 16 and for an average generation of a zero rotation torque, which, hence, does not allow the shaft of the pump 16 to rotate (at most, the pump 16 vibrates around the position in which it is located, without making significant movements); the stator windings, on the other hand, generate a thermal power due to Joule effect, which helps defrost the water inside the pump 16.

According to a further embodiment, the defrosting strategy implemented by the electronic control unit 26 entails supplying the stator windings with a substantially constant electric voltage V, but with a variable control frequency and/or supplying a variable power supply current.

According to a further embodiment, the defrosting strategy implemented by the electronic control unit 26 entails supplying the stator windings with a substantially constant electric voltage V, but with a variable control frequency and/or supplying a variable power supply current as well as varying the sequence of the stator windings supplied with power, for example according to a sequence A C B A C B.

In the embodiment shown in the accompanying figures, the injection of water is indirect and the electromagnetic injectors 14 do not inject the water into the cylinders 2, but inject the water into the intake ducts 8 upstream of the cylinders 2. According to an alternative embodiment which is not shown herein, the injection of water is direct and the electromagnetic injectors 14 inject the water into the cylinders 2; even in this embodiment, the water draining procedures described above are applied when the internal combustion engine stops 1 and the water filling procedures described above are applied when the internal combustion engine starts 1.

In the embodiment shown in the accompanying figures, the injection of fuel is direct and the electromagnetic injectors 12 inject the fuel into the cylinders 2. According to an alternative embodiment which is not shown herein, the injection of fuel is indirect and the electromagnetic injectors 12 inject the fuel into the intake ducts 8 upstream of the cylinders 2.

The direct or indirect fuel injection can be combined with the direct or indirect water injection.

The embodiments described herein can be combined with one another, without for this reason going beyond the scope of protection of the invention.

The injection system 13 described above has numerous advantages, since it is simple and economic to be manufactured, is particularly sturdy (hence, has a long operating life and a very low breaking risk) and, in particular, allows the electromagnetic injectors 14, the common rail 17 and the feeding duct 18 to be emptied in an particularly efficient, effective and side-effect-free manner when the internal combustion engine 1 is turned off. In particular, thanks to the use of the release valve 19 inside the water circuit, the air sucked in is (at least for the greatest part) air coming from the atmosphere, hence substantially at ambient temperature and free from high concentrations of contaminating/scaling elements. Furthermore, thanks to the use of the release valve 19 during the emptying and the filling, the electromagnetic injectors 14 (which are the most delicate components of the injection system 13 and, hence, are potentially most likely to be subjected to clogging or breaking) are basically flown through only by a flow of water which substantially is at ambient temperature and is absolutely free from high concentrations of contaminating/scaling elements

LIST OF THE REFERENCE NUMBERS OF THE FIGURES 1 engine
2 cylinders
3 intake manifold

4 intake valves
5 exhaust manifold
6 exhaust valves
7 throttle valve
8 intake duct
9 exhaust system
10 exhaust duct
11 injection system
12 electromagnetic injector
13 injection system
14 electromagnetic injector
15 tank
16 pump
17 common rail
18 feeding duct
19 release valve
20 air intake
21 pressure sensor
22 electric heater
23 electric heater
24 electric heater
25 electric motor
26 control unit
27 breathable membrane
28 adjusted narrowing
29 temperature sensor

The invention claimed is:

1. An injection method for the injection of water in an internal combustion engine (1); the injection method comprises the steps of:

operating, when the internal combustion engine (1) is turned on, a reversible pump (16) in order to suck water from a tank (15) and feed the water under pressure to at least one injector (14) through a feeding duct (18);

cyclically opening, when the internal combustion engine (1) is turned on, the injector (14) in order to inject the water towards at least one cylinder (2) of the internal combustion engine (1);

draining the water, when the internal combustion engine (1) is turned off, from the injector (14) and the feeding duct (18) by operating the pump (16) in order to suck the water from the feeding duct (18) and feed the water into the tank (15) and by opening a release valve (19), which is arranged along the feeding duct (18) and connects the feeding duct (18) to the outside;

measuring a pressure ($P_{H2O}$) of the water inside a common rail (17) to which the injector (14) is connected;

waiting a first amount (T1) of time between the activation of the pump (16) to suck the water from the feeding duct (18) and the opening of the release valve (19); and determining the end of the first amount (T1) of time as a function of the pressure ($P_{H2O}$) of the water inside the common rail (17);

wherein the end of the first amount (T1) of time is determined when the first derivative in time of the pressure ($P_{H2O}$) of the water inside the common rail (17) is below a first threshold.

2. An injection method according to claim 1, wherein the end of the first amount (T1) of time is determined when the first derivative in time of the pressure ($P_{H2O}$) of the water inside the common rail (17) is below a first threshold and, at the same time, the pressure ($P_{H2O}$) of the water inside the common rail (17) is below a second threshold.

3. An injection method according to claim 1 and comprising the further step of having the pump (16) continue to operate in order to suck the water from the feeding duct (18) and, at the same time, keeping the release valve (19) open for a second amount (T2) of time, which starts at the end of the first amount (T1) of time.

4. An injection method according to claim 3, wherein:

the injector (14) is oriented from the top to the bottom, so that an injection nozzle of the electromagnetic injector (14) is arranged in the lowest point;

at the end of the second amount (T2) of time, the pump (16) is turned off, the release valve (19) is kept open and the injector (14) is opened for a second amount (T4) of time, which starts at the end of the second amount (T2) of time; and at the end of the third amount (T4) of time, the release valve (19) is closed and the injector (14) is closed, thus completing a draining cycle.

5. An injection method according to claim 3, wherein:

the injector (14) is oriented from the bottom to the top, so that an injection nozzle of the electromagnetic injector (14) is arranged in the highest point;

at the end of the second amount (T2) of time, the pump (16) is turned off and the release valve (19) is closed, thus completing a draining cycle.

6. An injection method according to claim 3, wherein:

the injector (14) is oriented from the bottom to the top, so that the injection nozzle of the electromagnetic injector (14) is arranged in the highest point;

at the end of the second amount (T2) of time, the pump (16) is kept active in order to suck the water from the feeding duct (18) and the injector (14) is opened for a third amount (T3) of time, which starts at the end of the second amount (T2) of time; and at the end of the third amount (T3) of time, the pump (16) is stopped, the release valve (19) is closed and the injector (14) is closed, thus completing a draining cycle.

7. An injection method according to claim 1 and comprising the further step of filling, using the release valve (19), the feeding duct (18) and the injector (14) with water, when the internal combustion engine (1) is turned on.

8. An injection method according to claim 1, wherein the injector (14) is mounted inclined relative to the horizontal, so that, due to gravity, the water present inside the injector (14) is forced to flow towards the injection nozzle, when the injection nozzle is arranged in the lowest point, or is forced to flow in a direction opposite to the injection nozzle, when the injection nozzle is arranged in the highest point.

9. An injection method according to claim 1, wherein along a release duct provided with the release valve (19) there is inserted a breathable membrane (27), which is permeable to air and impermeable to water and/or is inserted in an adjusted narrowing (28).

10. An injection system (13) for the injection of water in an exhaust system (1) of an internal combustion engine (2); the injection system (13) comprises a control unit (26), which is configured to implement the injection method according to claim 1.

11. An injection method for the injection of water in an internal combustion engine (1); the injection method comprises the steps of:

operating, when the internal combustion engine (1) is turned on, a reversible pump (16) in order to suck water from a tank (15) and feed the water under pressure to at least one injector (14) through a feeding duct (18);

cyclically opening, when the internal combustion engine (1) is turned on, the injector (14) in order to inject the water towards at least one cylinder (2) of the internal combustion engine (1);

filling with water, when the internal combustion engine (1) is turned on, the feeding duct (18) and the injector (14) by operating the pump (16) in order to suck the water from the tank (15) and feed the water into the feeding duct (18) and by opening a release valve (19), which is arranged along the feeding duct (18) and connects the feeding duct (18) to the outside;

measuring a pressure ($P_{H2O}$) of the water inside a common rail (17) to which the injector (14) is connected; and closing, during the filling of the feeding duct (18) and of the injector (14), the release valve (19) as a function of the pressure ($P_{H2O}$) of the water inside the common rail (17);

wherein the release valve (19) is closed when the first derivative in time of the pressure ($P_{H2O}$) of the water inside the common rail (17) exceeds a first threshold.

12. An injection method according to claim 11, wherein the release valve (19) is opened when the first derivative in time of the pressure ($P_{H2O}$) of the water inside the common rail (17) exceeds a first threshold and, at the same time, the pressure ($P_{H2O}$) of the water inside the common rail (17) exceeds a second threshold.

13. An injection method according to claim 11 and comprising the further step of also opening the injector (14) during the filling of the feeding duct (18) and of the injector (14).

14. An injection system (13) for the injection of water in an exhaust system (1) of an internal combustion engine (2); the injection system (13) comprises a control unit (26), which is configured to implement the injection method according to claim 11.

* * * * *